US006076219A

United States Patent [19]

Irwin

[11] Patent Number: 6,076,219

[45] Date of Patent: Jun. 20, 2000

[54] WASTE LINE CLEAN OUT APPARATUS

[76] Inventor: Lawrence F. Irwin, 12860 San Fernando Rd., Sylmar, Calif. 91342

[21] Appl. No.: 09/232,067

[22] Filed: Jan. 15, 1999

[51] Int. Cl.[7] ..... B08B 9/02

[52] U.S. Cl. ..... 15/104.33

[58] Field of Search ..... 15/104.31–104.33

[56] References Cited

U.S. PATENT DOCUMENTS

| | | | |
|---|---|---|---|
| 2,266,659 | 12/1941 | Robinson et al. | 15/104.33 X |
| 2,272,387 | 2/1942 | Therrien | 15/104.33 |
| 2,355,733 | 8/1944 | Johnson et al. | 15/104.33 |
| 2,705,642 | 4/1955 | Chasar | 15/104.33 X |
| 3,213,473 | 10/1965 | Singer | 15/104.33 |
| 3,414,926 | 12/1968 | Bloom | 15/104.33 |
| 3,958,293 | 5/1976 | Irwin | 15/104.33 |
| 3,983,593 | 10/1976 | Naeve | 15/104.33 |
| 4,447,926 | 5/1984 | Rothenberger | 15/104.33 |
| 5,193,242 | 3/1993 | Irwin | 15/104.33 |
| 5,603,136 | 2/1997 | Truschler | 15/104.33 |
| 5,657,505 | 8/1997 | Gallagher et al. | 15/104.33 |

FOREIGN PATENT DOCUMENTS

| | | | |
|---|---|---|---|
| 4301179 | 7/1994 | Germany | 15/104.33 |

OTHER PUBLICATIONS

Advertisement: Ridgid/Kollmann (Attached pp. 1 and 2) Sewerooter Senior (Attached p. 3) Root 66 (Attached p. 3).

*Primary Examiner*—Mark Spisich
*Attorney, Agent, or Firm*—James E. Brunton

[57] ABSTRACT

An improved power driven waste line clean out apparatus of the type that includes an elongated flexible coil spring that is selectively rotated by a novel operating mechanism in a manner to permit sections of the coiled spring to be sequentially fed into and retracted from the waste line to be cleaned as the operating mechanism reciprocates back and forth along a pair of generally horizontally extending guide members mounted on the base of the apparatus. In operation, the coiled spring is first gripped by the operating mechanism in a manner to cause rotation of the spring about its axis so that a feed mechanism will advance a section of the coil spring into the waste line. The coiled spring is then released so that the operating mechanism can be returned to its initial starting position to enable additional sections of the coil spring to be advanced into the clogged waste line.

20 Claims, 16 Drawing Sheets

FIG. 8
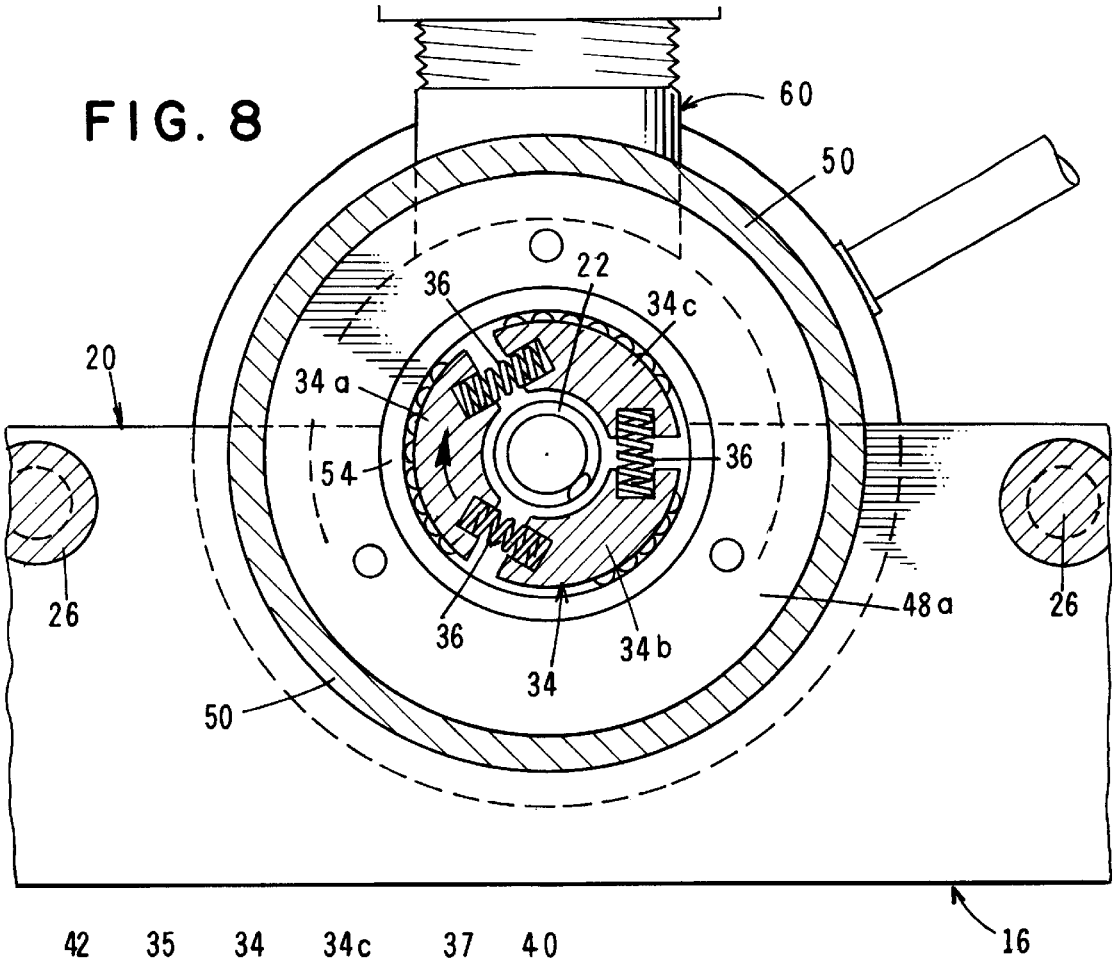
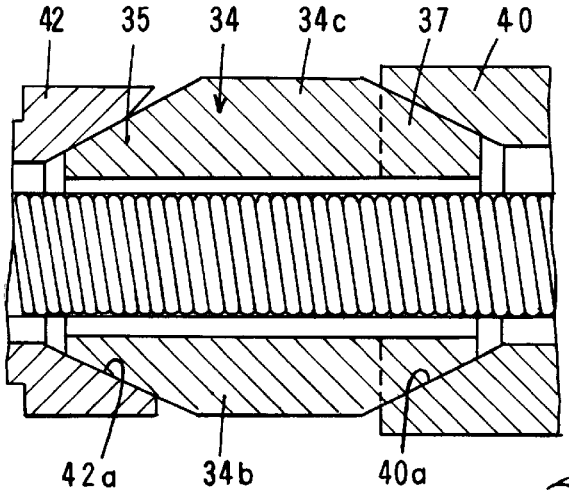
FIG. 9
FIG. 10
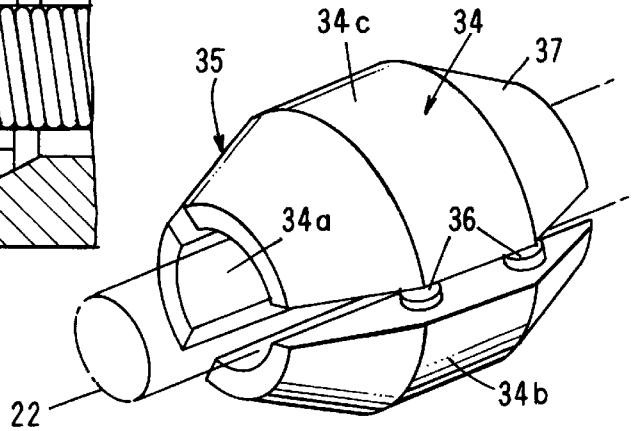

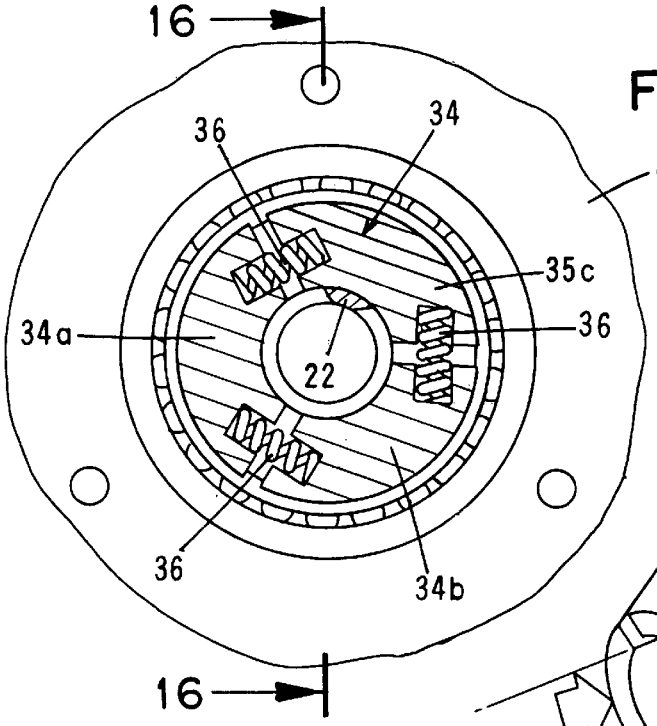
FIG. 15
FIG. 17
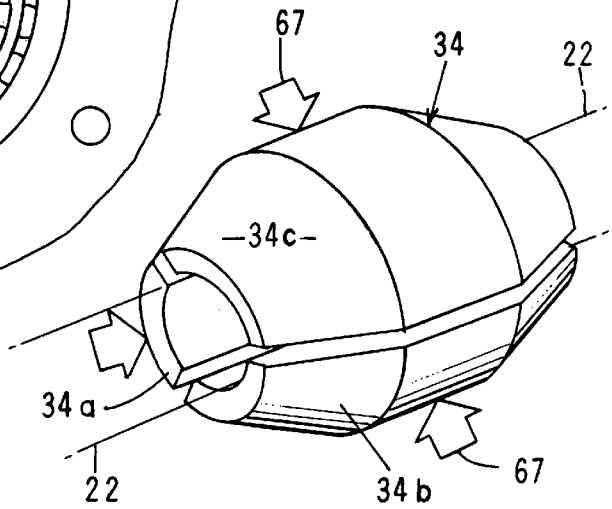
FIG. 16
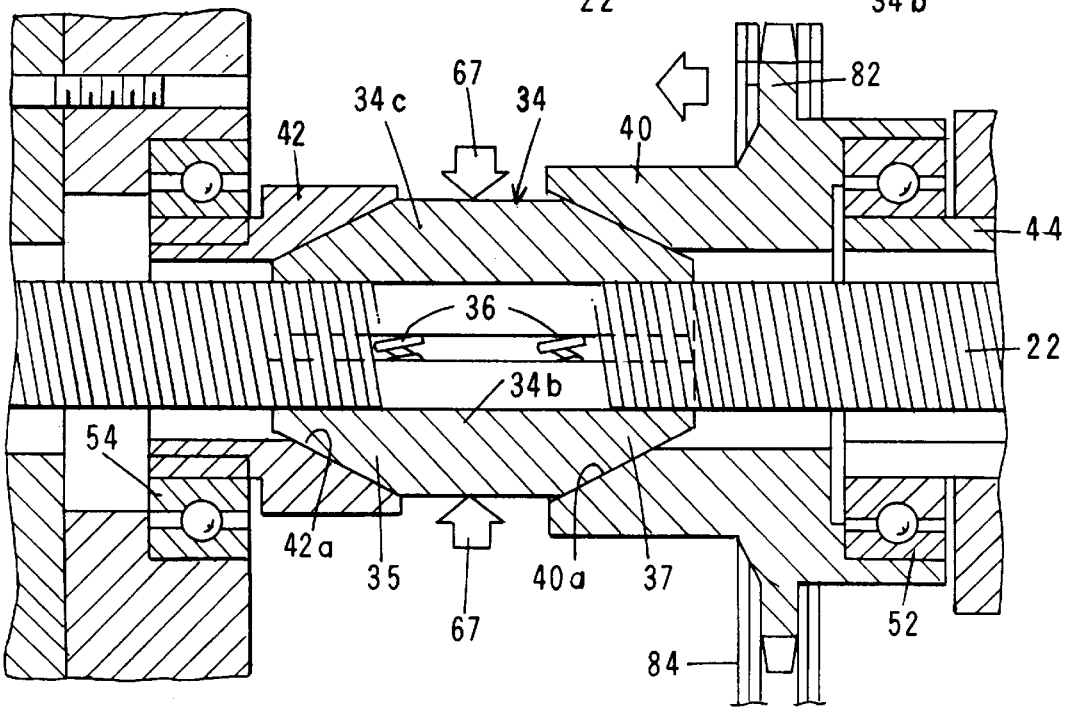

20
24a
26
26a
56
56a
56b
90
24
24a
14
50
48
22
62
20
92
78
72
30
74
70
84
86
16
16
18
95a
95
60
22
WL 32a
32
56a
56
56a
56
56b
90
62
20
22
26
24a
24
92
78
30
16
18
72
74
70
86
84
95
14
50
48
60
22
WL

WASTE LINE CLEAN OUT APPARATUS

BACKGROUND OF THE INVENTION

1. Field of the Invention

The present invention relates generally to plumbers' tools. More particularly, the invention concerns a waste line clean out apparatus for removing and cleaning away obstructions formed in and blocking the waste line.

2. Discussion of the Prior Art

A wide variety of waste line clean out devices have been suggested in the past. Normally, such devices embody an elongated clean out member known as a plumbers' snake. The plumbers' snake is ordinarily housed within a drum or hollow housing having a conical wall through which the spring or snake is fed and rotated actually of itself as the container is rotated to cause rotation of the spring. The feed mechanism for advancing the coiled spring into the waste line typically includes jaws, rollers, segmented nuts or like structures which grip the spring so that when the spring is fed through the feed while being rotated it is controllably advanced into or retracted from the sewer line. As a general rule, cutter means affixed to the free end of the plumbers' snake and functions to cut away and clear blockages formed in the sewer line.

A drawback of the prior art devices which embody rotating drums resides in the fact that a rotating drum cannot feed the coiled spring without the use of the gripping chuck of the automatic feed. Accordingly, when extreme resistance is encountered in the waste line, an unsafe condition can arise. The apparatus of the present invention uniquely overcomes this drawback.

One of the most successful prior art waste line clean out apparatus ever devised is illustrated and described in U.S. Pat. No. 5,193,242 issued to the present inventor. This patent describes an apparatus having certain components that are similar to the present apparatus and accordingly U.S. Pat. No. 5,193,242 is hereby incorporated by reference as though fully set forth herein.

Another highly successful prior art waste line clean out apparatus is described in U.S. Pat. No. 3,956,923 also issued to the present inventor.

Both of the prior art devices identified in the preceding paragraphs embody a relatively large rotatable drum which houses the enlarged coiled spring and imparts rotation thereto so that it can be advanced into and retracted from the waistline. As will be better understood from the description which follows, the apparatus of the present invention eliminates the rotatable drum and includes a highly novel means for selectively rotating the coiled spring so that it can be controllably advanced into and retracted from the waste line.

SUMMARY OF THE INVENTION

By way of summary the apparatus of the present invention uses an elongated clean out member in the form of a coil spring wire or a plumber's snake which is controllably advanced into and retracted from the waste line to be cleaned by a feed means. The apparatus comprises a uniquely designed operating mechanism, which when operated by the user grips the coiled spring causing it to rotate about its longitudinal axis so that it can be acted upon by the feed mechanism to advance the rotating coiled spring into the waste line. As the coiled spring is advanced by the feed mechanism, the operating mechanism slides forwardly along a pair of guide members carried by the frame. A reverse force imparted to the operating mechanism will release the coil spring so as to permit the operating mechanism to be moved rearwardly along the guide rods to its initial starting position.

It is an object of the present invention to provide an improved power driven apparatus of the type that comprises an elongated flexible coil spring which is selectively rotated by a novel operating mechanism in a manner to permit sections of the coiled spring to be sequentially fed into and retracted from the waste line to be cleaned as the operating mechanism reciprocates back and forth along a pair of generally horizontally extending guide members.

A particular object of the invention is to provide an apparatus of the aforementioned character in which the coiled spring is first gripped by the operating means in a manner to cause rotation of the spring about its axis so that the feed means will advance the coil spring and then is released so that the operating mechanism can be returned to its initial starting position.

Another object of the invention is to provide an apparatus of the character described in the preceding paragraphs which is compact, light weight and easy to use by a relatively unskilled operator.

Another object of the invention is to provide a waste line clean out tool that can be used in tight spaces and can be conveniently positioned close to the inlet of the waste line to be cleaned.

It is another object of this invention to provide a chucking system to safely grip the coiled cable against in line resistance while at the same time rotating the chuck and cable when being fed automatically forward or reverse and providing instant chuck release under extreme resistance that releases pressure on the cable both a forward and backward area of the chuck.

It is a further object of the invention to provide a system to slide and guide the turning chuck and coiled cable as the feed mechanism pulls the cable in either a forward or reverse direction.

Another object of the invention is to provide an apparatus of the class described which is highly versatile, is of a simple straight forward design and is relatively inexpensive to manufacture.

BRIEF DESCRIPTION OF THE DRAWINGS

FIG. 8 is a greatly enlarged cross-sectional view taken along lines 8—8 of FIG. 7.

FIG. 9 is an enlarged cross-sectional view of a portion of the chucking means of the apparatus for gripping the coil spring to impart rotation thereto.

FIG. 10 is an enlarged, generally perspective view of the segmented chuck of the chucking means.

FIG. 15 is an enlarged cross-sectional view taken along lines 15—15 of FIG. 14.

FIG. 16 is an enlarged cross-sectional view taken along lines 16—16 of FIG. 15.

FIG. 17 is a generally perspective view of the segmented chuck of the device in gripping engagement with the coiled spring for retracting the spring from the waste line.

DESCRIPTION OF THE INVENTION

Figure 1:
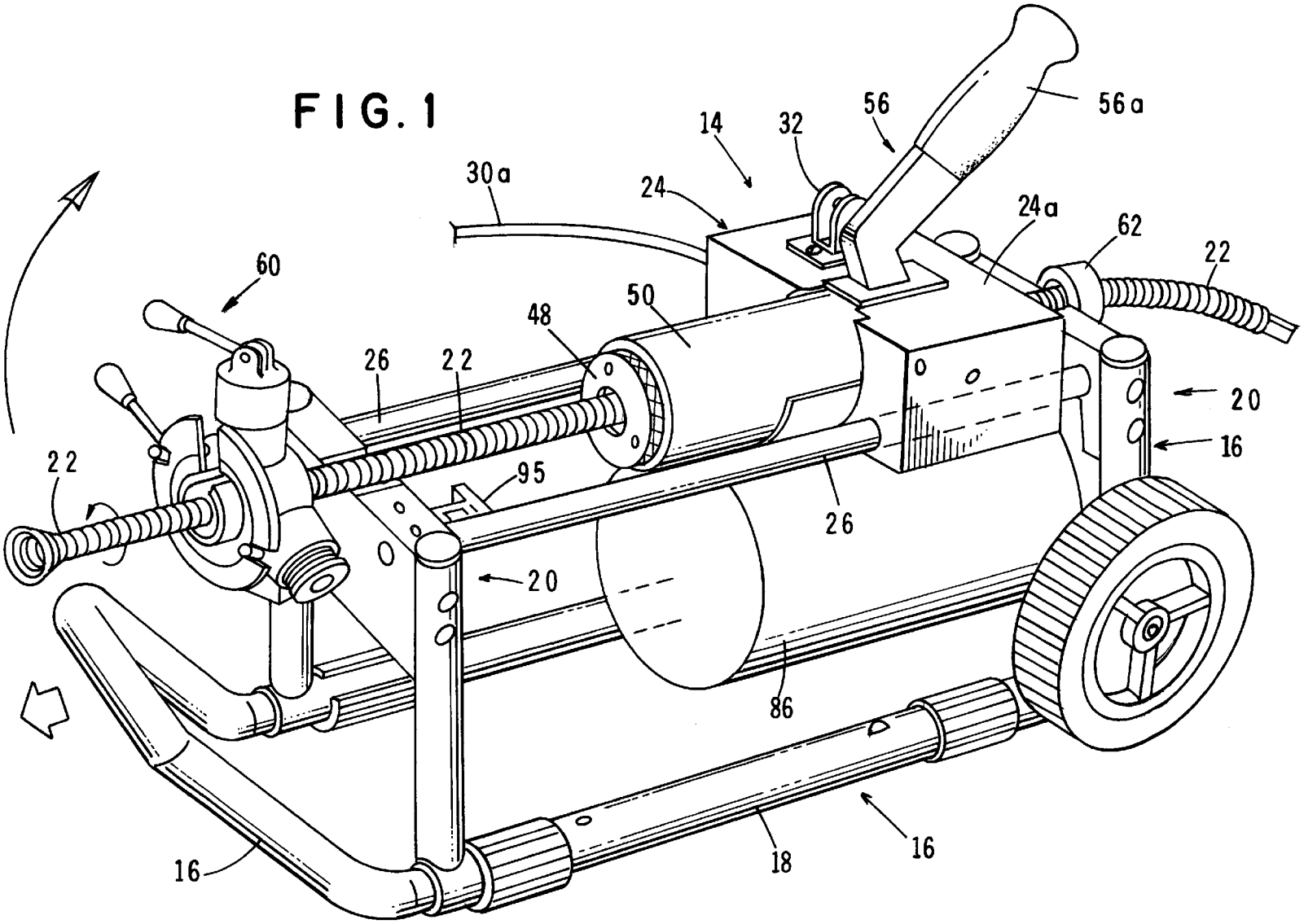
FIG. 1 is a generally perspective view of one form of the waste line clean out apparatus of the present invention.

Referring to the drawings and in particularly to FIGS. 1 through 4, one form of the waist line clean-out tool of the invention is there illustrated and there generally designated by the numeral 14. As best seen by referring to FIG. 1, the tool here comprises a wheeled base 16, having a lower ground engaging portion, 18, and an upper operating means supporting portion 20. Extending longitudinally of base 16 is an elongated coiled spring or plumber's snake 22.

Figure 6:
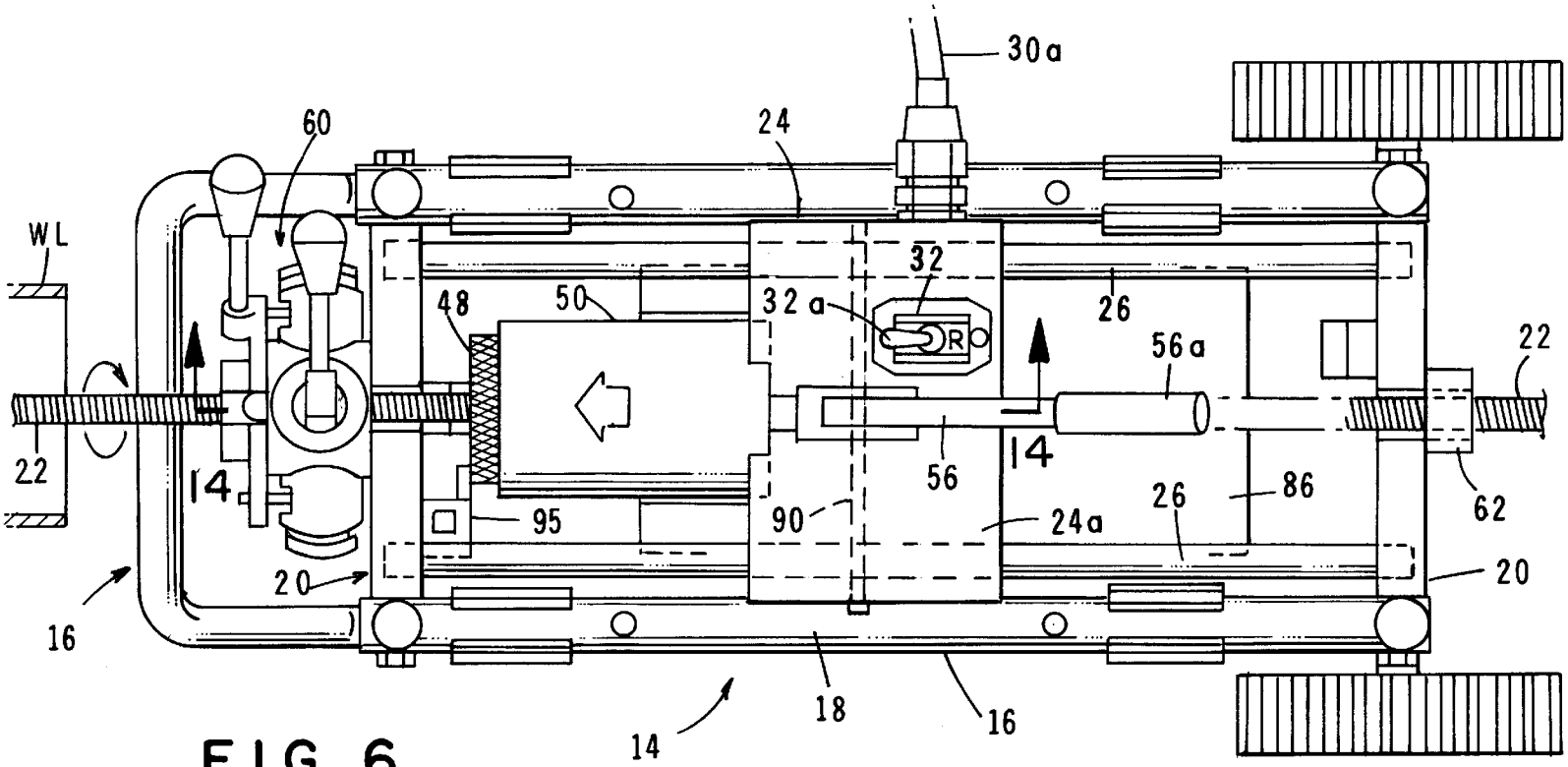
FIG. 6 is a top plan view similar to FIG. 4, but showing the operating mechanism in a fully advanced position and the operating switch in a forward position.
Figure 7:
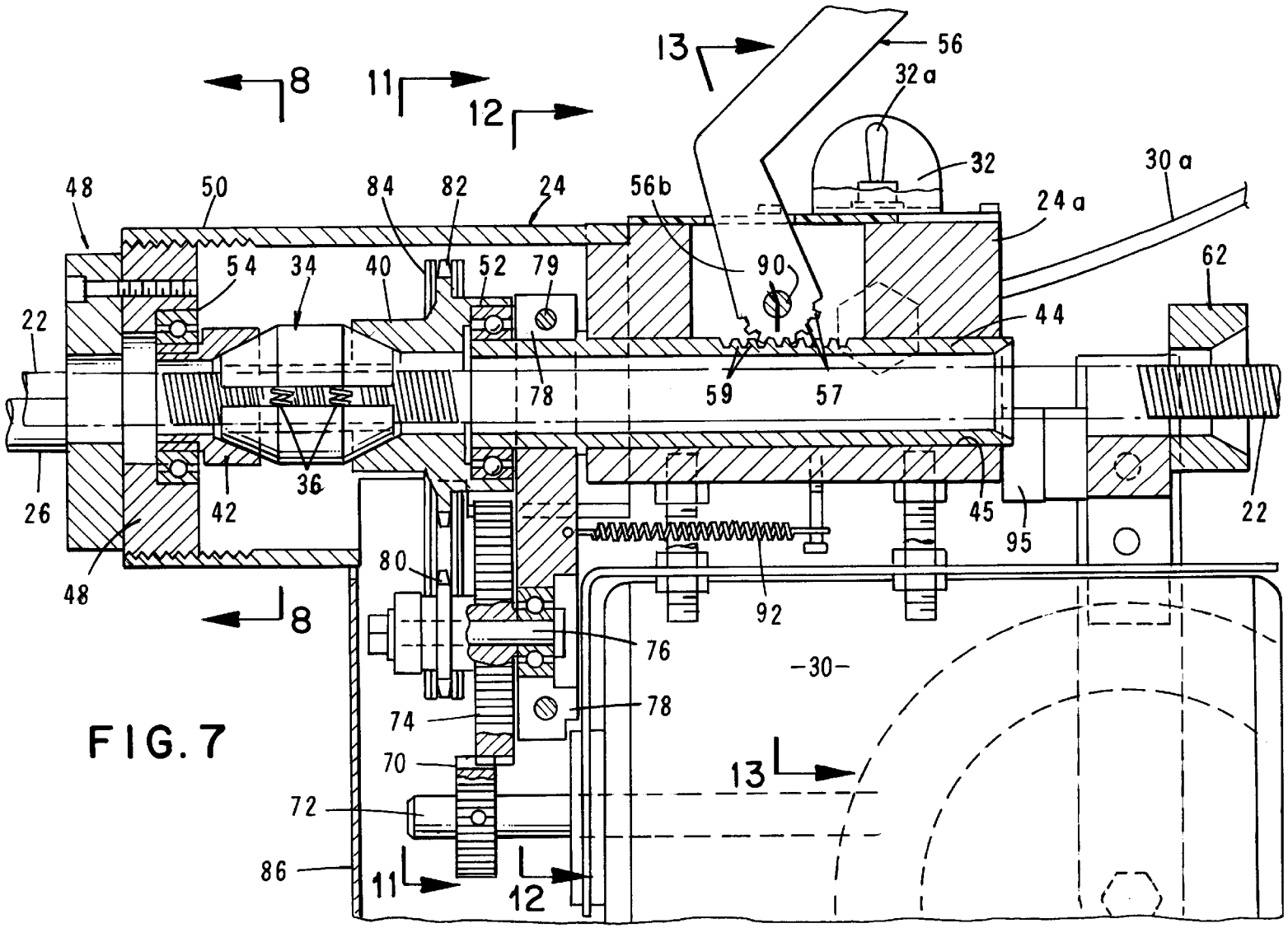
FIG. 7 is an enlarged, cross-sectional view taken along lines 7—7 of FIG. 4.
Figure 11:
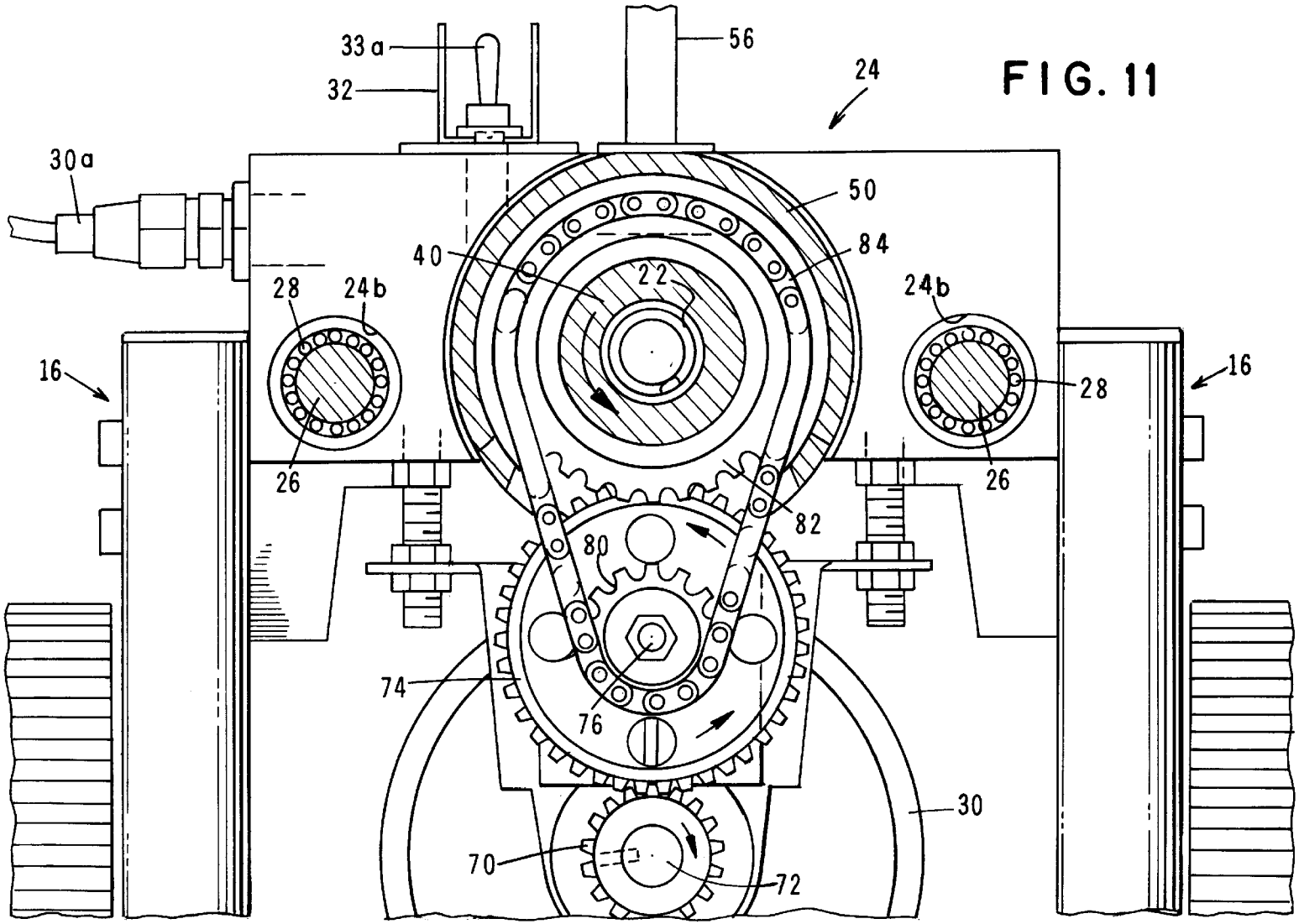
FIG. 11 is a cross-sectional view taken along lines 11—11 of FIG. 7.

The novel operating means of the present form of the invention, which functions to selectively impart rotation to coil spring 22 about its longitudinal axis, here comprises a carriage assembly 24 which is slidably movable along a pair of generally horizontally guide members or rods 26 which are affixed to the upper portion 20 of base 16 in the manner shown in FIG. 1. As best seen in FIGS. 7 and 11, carriage assembly 24 includes a generally block like member 24*a* having a pair of transversely spaced apart bores 24*b*. Mounted within each of the bores 24*b* is a bearing set 28 (FIG. 11) which functions to permit the carriage 24*a* of carriage assembly 24 to smoothly reciprocate along guide members 26 between a first position shown in FIG. 1 and a second position shown in FIGS. 5 and 6.

Also forming an important part of the operating means of the invention is a highly novel chucking means that is carried by carriage assembly 24 for movement between a first relaxed position and second snake gripping position. More specifically, the chucking means here functions to grip coil spring 22 when the chucking means is moved toward the second position shown in FIG. 16. Movement of the chucking means into the second, snake gripping position is accomplished by actuating means, the character of which will presently be described.

Figure 2:
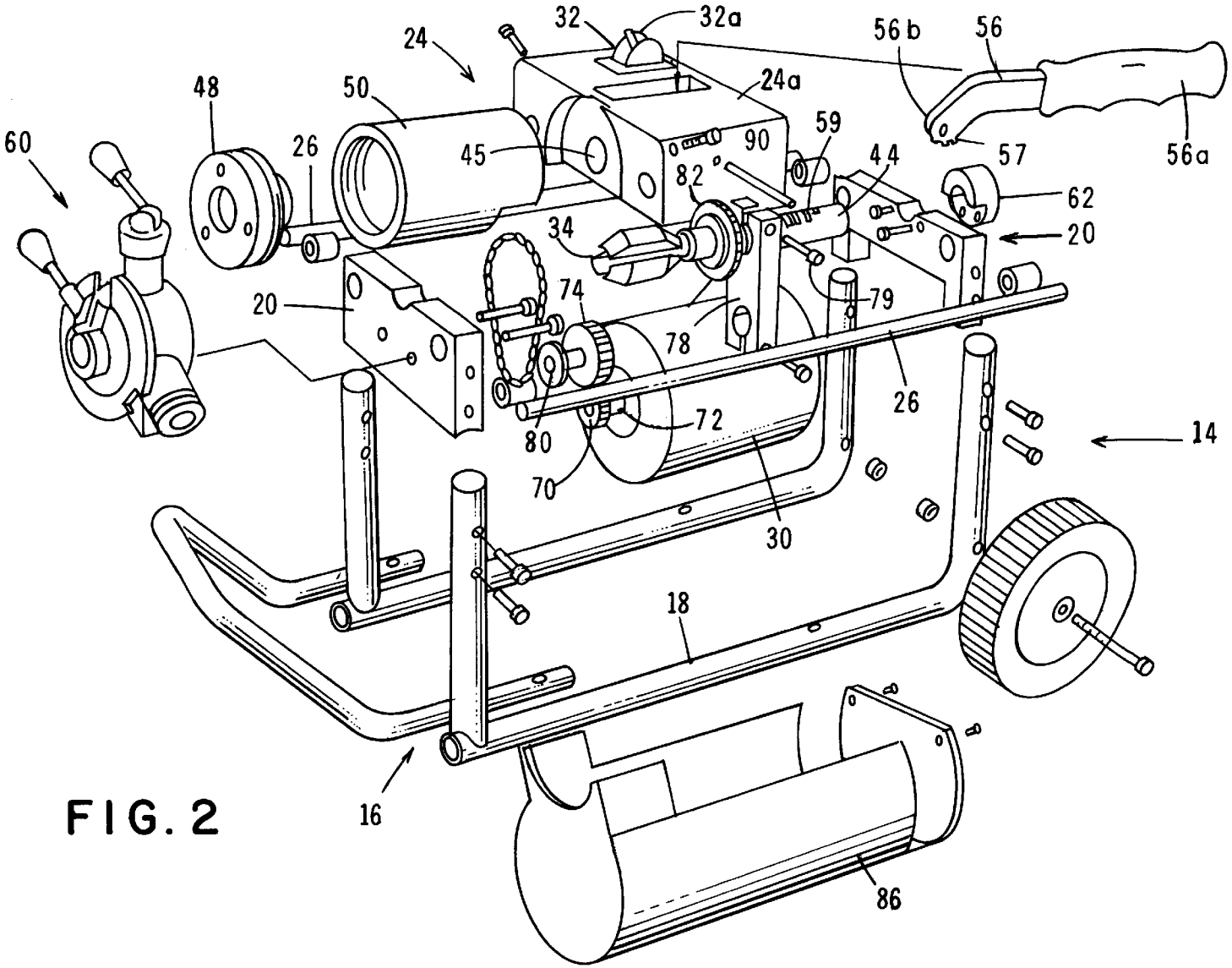
FIG. 2 is a generally perspective exploded view of the apparatus shown in FIG. 1.

The important operating means of the invention further includes drive means for rotating a portion of the chucking means to impart rotation to coil spring 22 when the chucking means is in the snake gripping position shown in FIG. 16. As best seen in FIG. 2, the important drive means of the invention includes a reversible electric motor 30 which is of conventional construction and is selectively energized by operation of a switch means, shown here as a conventional toggle switch mechanism 32.

Turning particularly to FIGS. 8, 9 and 10, the chucking means of the invention can be seen to include a novel segmented chuck 34 which comprises three circumferentially spaced segments 34*a*, 34*b* and 34*c*. (FIG. 8). Segments 34*a*, 34*b* and 34*c* are maintained in the relaxed, spaced apart configuration shown in FIG. 8 by segment biasing means here provided in the form of a plurality of coiled springs 36. Each of the chuck segments 34*a*, 34*b* and 34*c*, is provided with first and second tapered end portions 35 and 37 respectively. As best seen in FIGS. 7 and 9, chuck 34 is disposed between first and second camming members 40 and 42 each of which includes inwardly sloping, tapered surfaces 40*a* and 42*a* respectively. During the waste line clean out operation, surfaces 40*a* and 42*a* are adapted to engage tapered surfaces 35 and 37 provided on chuck segments 34*a*, 34*b* and 34*c* in a manner to force the chuck into gripping engagement with the snake 22.

In addition to camming members 40 and 42, the chucking means of the present form of the invention also includes an elongated tubular member 44 which is slidably carried within a central bore 45 provided in carriage 24*a* (FIGS. 2 and 7). As best seen in FIG. 7, camming member 40 is rotatably supported by tubular member 44, while camming member 42 is rotatably supported by an end plate assembly 48 which is connected to a generally cylindrically shaped, hollow housing 50. Housing 50 forms a part of the carriage assembly 24 of the invention and is interconnected with carriage 24*a* in the manner best seen in FIGS. 2 and 7. As illustrated in FIG. 7, first camming member 40 is rotatably connected to tubular member 44 by means of a bearing assembly 52 that permits free rotation of camming member 40 relative to tubular member 44. Similarly, second camming member 42 is rotatably connected to plate 48*a* of plate assembly 48 by means of a bearing assembly 54 which permits free rotation of camming member 42 relative to plate 48*a*. With the construction shown, camming member 40 along with chuck 34 can be controllably rotated either in a clockwise or a counter clockwise direction by the drive means of the invention, the details of construction of which will be presently described.

Figure 14:
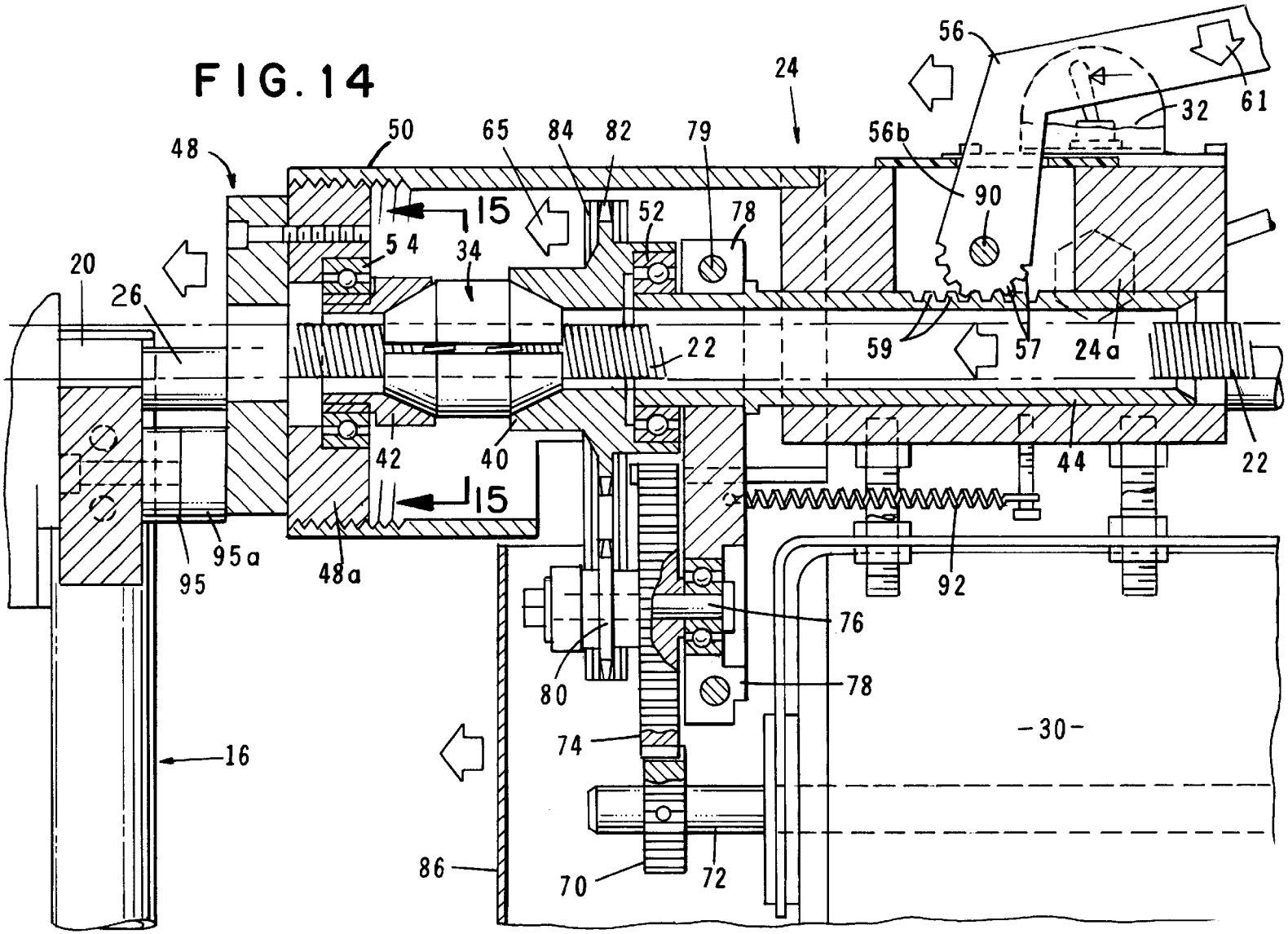
FIG. 14 is a cross-sectional view similar to FIG. 7, but showing the operating handle in a downward position urging the chucking means of the apparatus forwardly of the base.

Referring once again to FIG. 1, the actuating means of the present invention comprises a lever like member 56 having a first handle grip end portion 56*a* and a second chucking means engaging end portion 56*b* which includes a plurality of arcuately arranged teeth 57. As indicated in FIG. 7, teeth 57 are adapted to operably engage a series of longitudinally spaced apart rack-like teeth 59 formed on the upper surface of tubular member 44. (See also FIGS. 2 and 14) As illustrated in FIGS. 14 and 16, when the actuating means or handle 56 is moved from the position shown in FIG. 1 to the lowered position shown in FIG. 14, teeth 57 will engage rack-like teeth 59 provided on tubular member 44 urging the tubular member forwardly from a first position shown in FIG. 7 to a second position shown in FIG. 14. This forward movement of tubular member 44 also causes a forward movement of first camming member 40 which, in turn, causes segmented chuck 34 to move into camming engagement with second camming member 42. As the segmented chuck 34 moves into camming engagement with member 42, the segments 34*a*, 34*b* and 34*c* thereof will be cammed inwardly in the manner illustrated in FIG. 16 so that the chuck moves, against the urging of springs 36, into secure gripping engagement with coil spring 22. When the chucking segments are thus engaged with snake 22, rotation of camming member 40 by the drive means of the invention will impart rotation to coiled spring 22 in either a clockwise (forward) or counter-clockwise (reverse) direction depending upon the position of the control switch 32*a* of toggle switch assembly 32.

Figure 3:
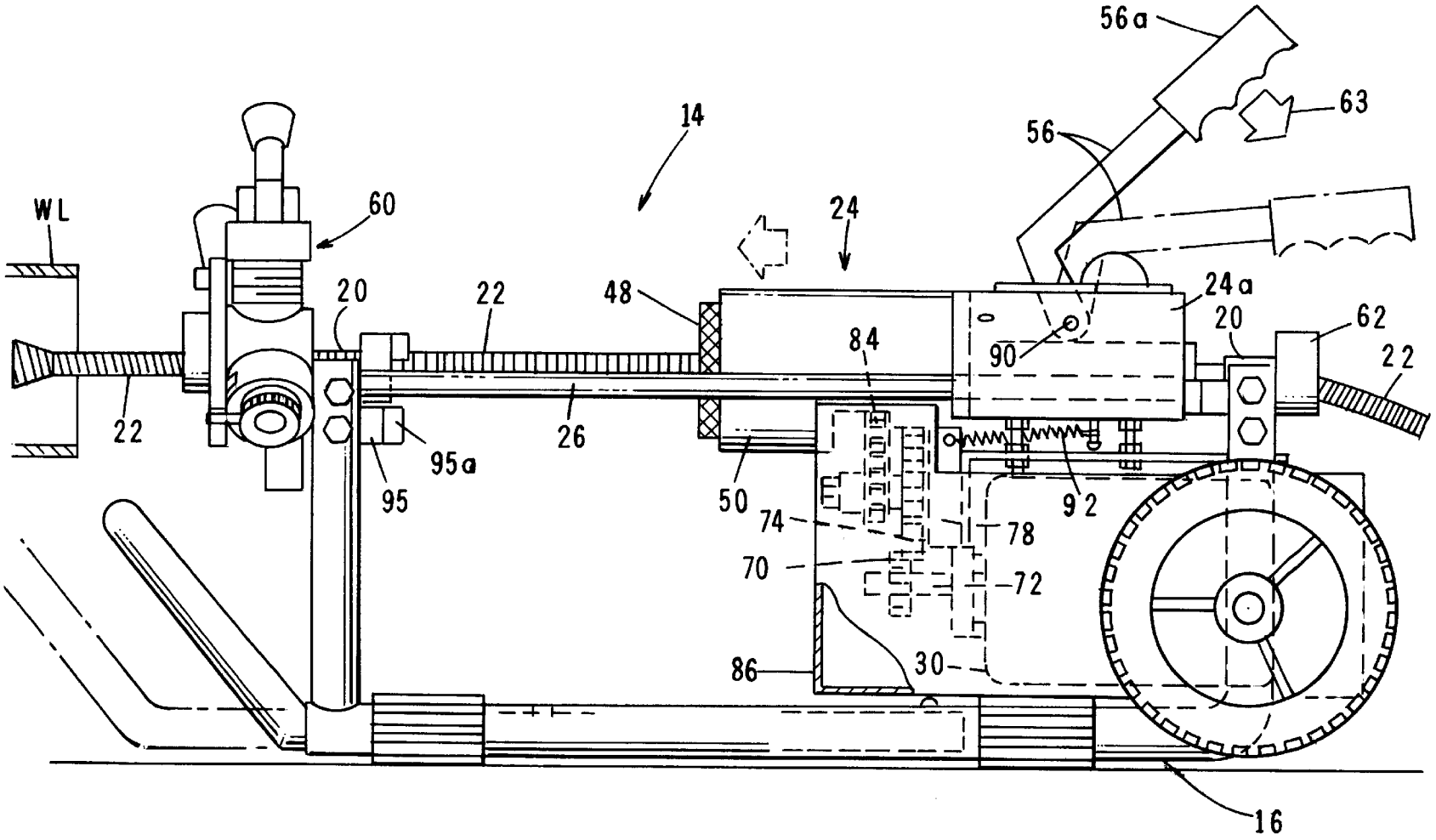
FIG. 3 is a side elevational view of the apparatus shown in FIG. 1.

In order to advance the rotating coil spring 22, the previously mentioned feed means of the invention is provided proximate the upper, forward end of frame 16 in the manner shown in FIG. 3. This drive means, which functions to either advance or retract coil spring 22 depending upon the position of switch 32*a* can comprise gripping jaws, rollers, segmented nuts or like structures which grip the spring so that it will be urged through the feed as it is rotated. The feed means shown in the drawings is of the character illustrated and described in U.S. Pat. No. 4,580,308 issued to the present inventor and reference should be made to this patent for a detailed description of the construction and operation of the feed means. While the feed means of the '308 patent is quite suitable for use in connection with the apparatus of the present invention, feed means of other design may also be used so long as they effect a uniform feeding of the rotating snake into or out of the waistline to be cleaned depending upon the direction of rotation of the spring.

With the various components of the invention, interconnected in the manner shown in FIGS. 1 through 7 so that coiled spring 22 extends longitudinally of the apparatus through a rearward guide member 62 provided on the rearward portion of frame 16, through tubular member 44, through segmented chuck assembly 34 and finally through feed means 60, the apparatus is ready for operation in the manner next to be described. Turning particularly to FIGS. 7 and 14 it is to be observed that a downward force exerted on the actuating means or handle 56 in the direction of the arrow 61 of FIG. 14 will cause forward movement of tubular member 44 from the position shown in FIG. 7 to the position shown in FIG. 14. This forward movement of tubular member 44 will also cause forward movement of camming member 40 in the direction of arrow 65 of FIG. 14. Forward movement of camming member 40 will urge the tapered portions of the three segments of chuck 34 into pressural engagement with camming member 42. In the manner illustrated in FIG. 16, this forward movement of camming member 40 will cause the segments of the chuck to move into engagement with camming member 42 which, in turn, will cause the segments to move against the urging of springs 36 inwardly in the direction of the arrows 67 of FIG. 16 into pressural engagement with coil spring 22.

Figure 12:
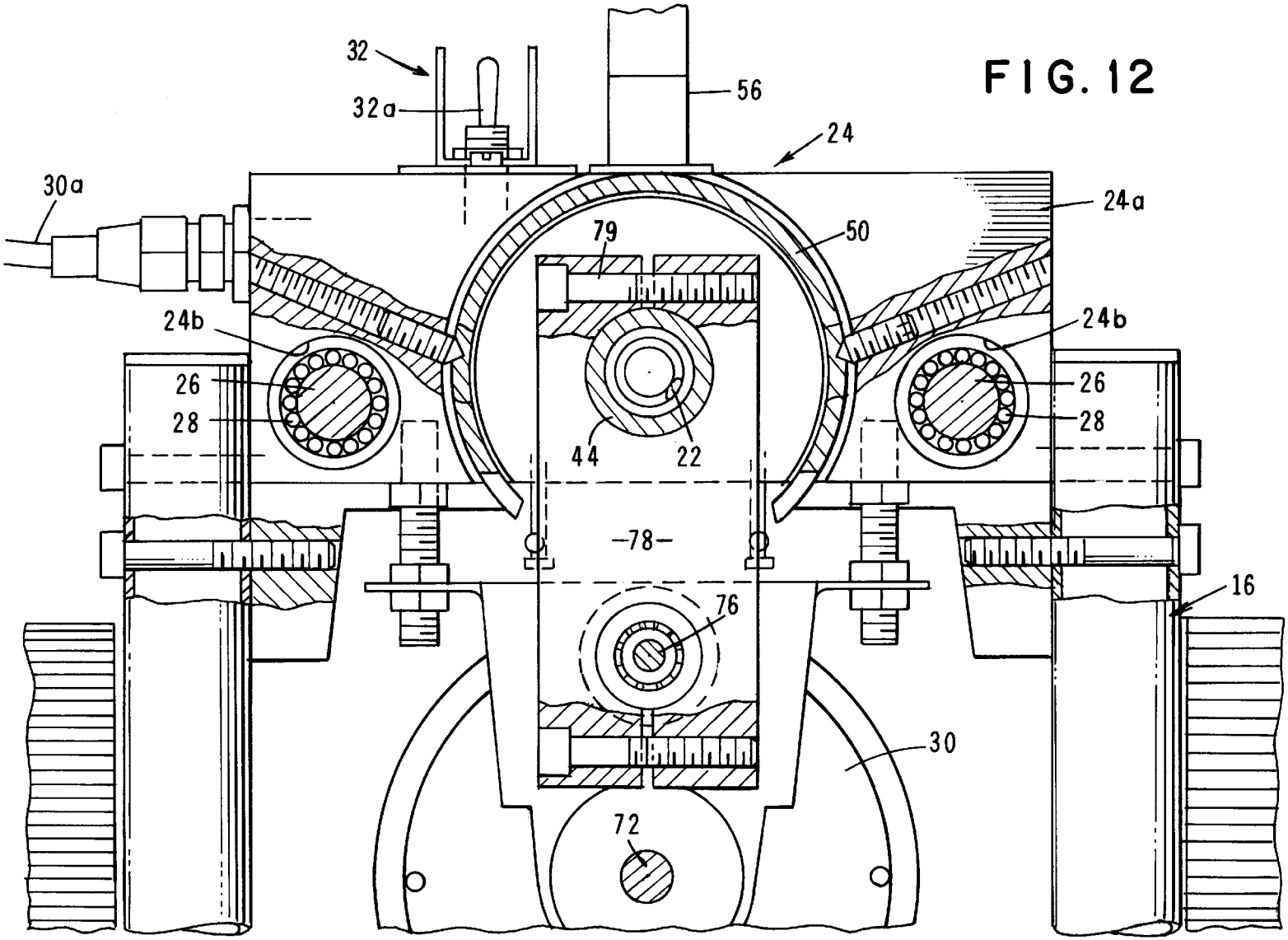
FIG. 12 is a cross-sectional view taken along lines 12—12 of FIG. 7.
Figure 13:
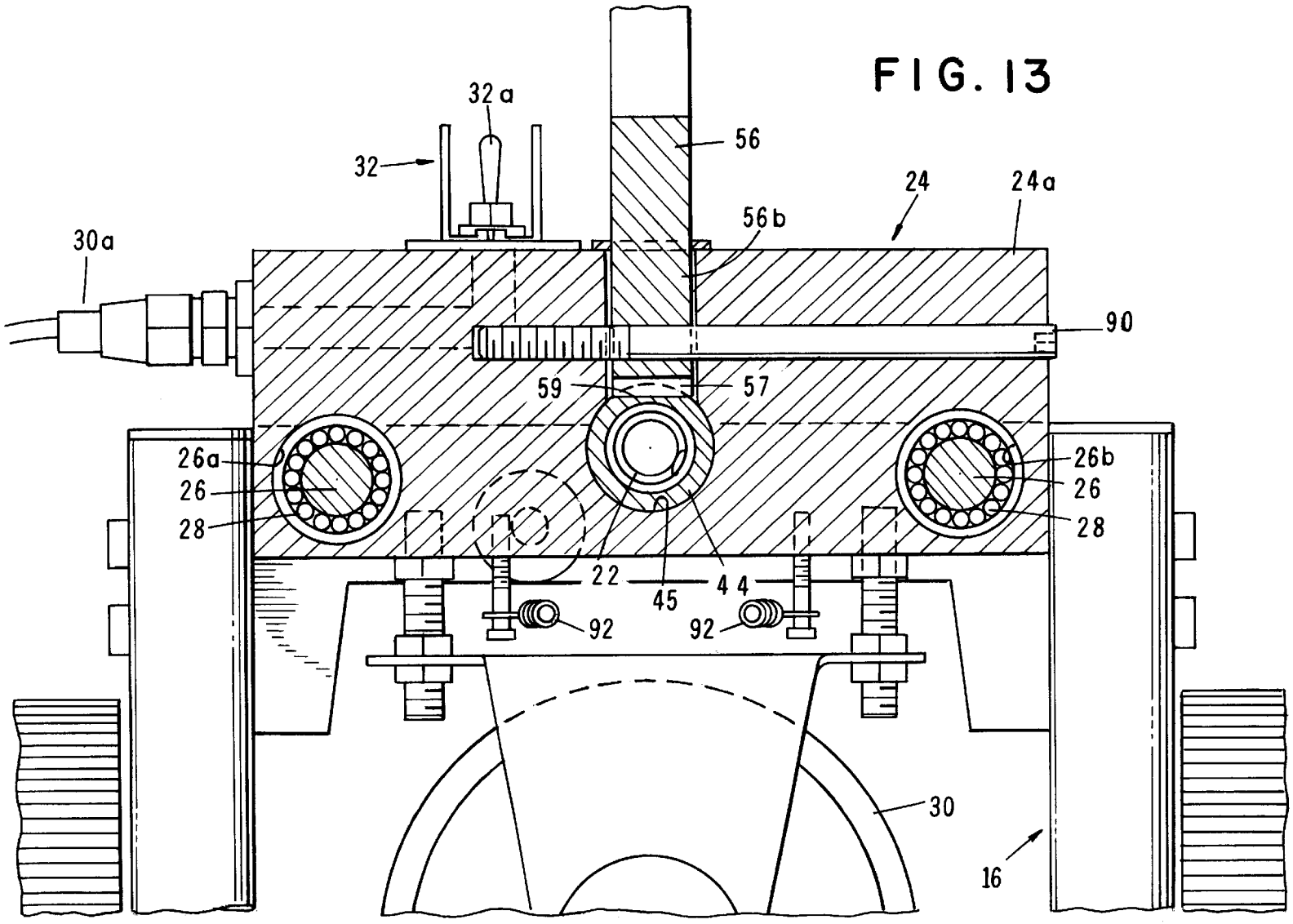
FIG. 13 is an enlarged cross-sectional view taken along lines 13—13 of FIG. 7.

It is also to be noted by referring to FIGS. 7 and 14 that a forward movement of tubular member 44 will cause a movement of the cooperating gears of the drive means of the invention from the first mis-aligned position shown in FIG. 7 to the second aligned position shown in FIG. 14. As indicated in FIGS. 7, 11 and 14, the drive means of the present form of the invention comprises a drive gear 70 which is connected to and driven by a drive shaft 72 provided on electric motor 30. Drive gear 70 is adapted to mesh with a driven gear 74 which is rotatably mounted on a shaft 76 which, in turn, is rotatably connected to a support plate 78. As best seen in FIGS. 2 and 12, support plate 78 is connected to tubular member 44 by a clamping screw 79. In this regard it is to be observed that as sleeve 44 is urged forwardly by the actuating means or handle 56, support plate 78 along with driven gear 74 will move from the mis-aligned position shown in FIG. 7, to the aligned position shown in FIG. 14, in which position gears 70 and 74 are disposed in direct driving alignment.

Also connected to shaft 76 and rotatable therewith is a first sprocket 80 which rotates with driven gear 74 as driven gear 74 is driven by driving gear 70. (See also FIG. 2) A second sprocket wheel 82 forms a part of camming member 40 and is operably interconnected with first sprocket 80 by means of an endless chain 84 of conventional construction (FIGS. 2, 7 and 11). As indicated in FIGS. 2 and 7, sprocket wheel 82 is protectively enclosed by the previously mentioned, generally cylindrically shaped housing 50, while drive gears 70 and 74, along with sprocket wheel 80 are protectively enclosed within a housing 86 which surrounds the lower portion of the drive means of the invention in a manner shown in FIGS. 1 and 7.

Figure 4:
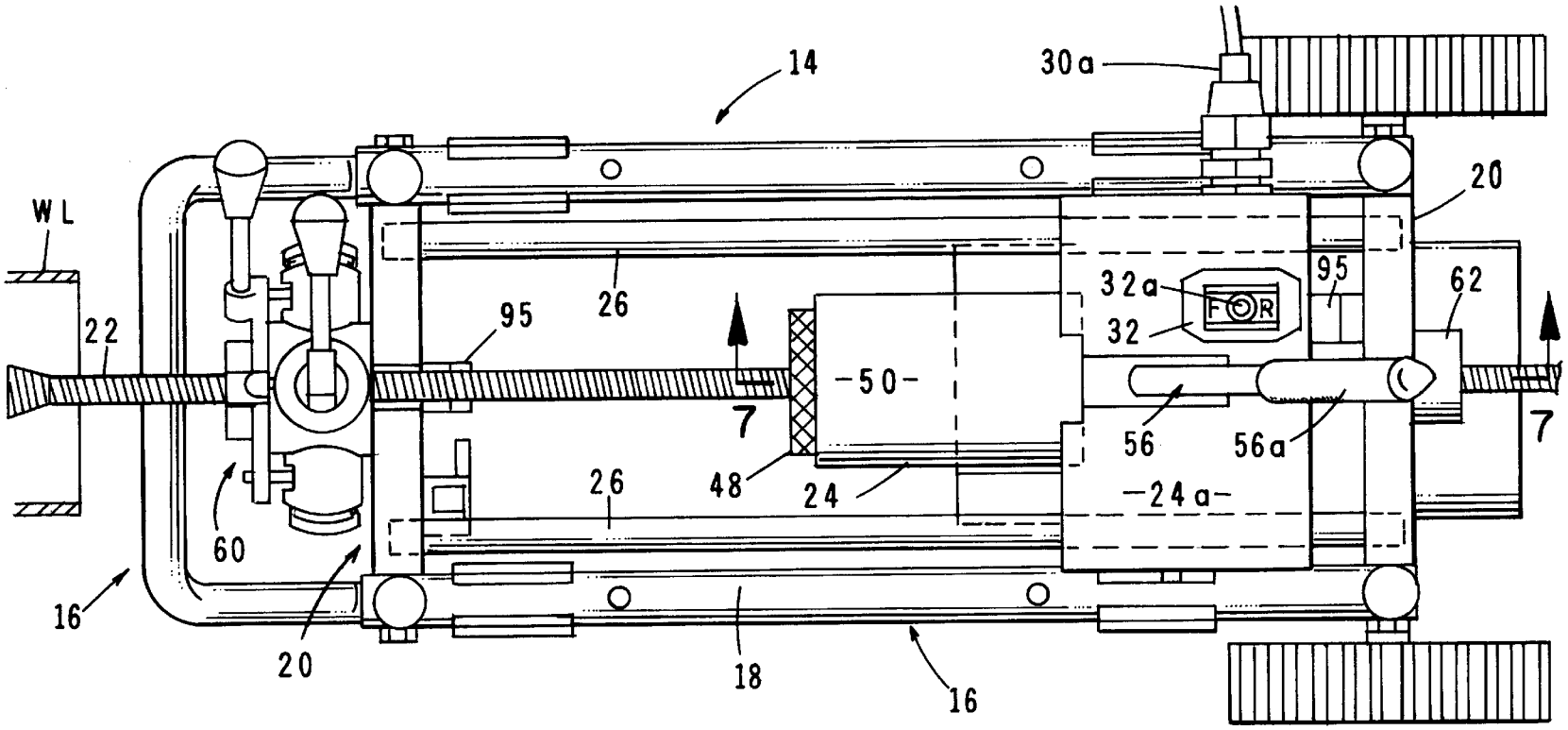
FIG. 4 is a top plan view of the apparatus with the operating switch shown in a neutral position.
Figure 4A:
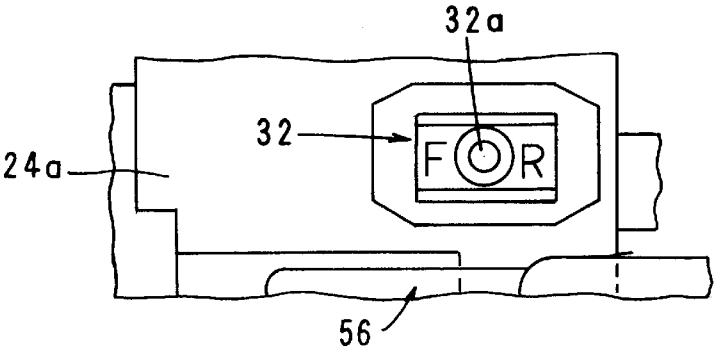
FIG. 4A is an enlarged fragmentary top plan view of the operating switch.

With the apparatus of the invention positioned proximate the waste line WL to be cleaned out, as illustrated in FIGS. 3 and 4, and with the electric motor 30 interconnected with a source of electrical power by a conventional electrical connector 30*a* (FIG. 4), the waste line clean out process can begin. This process is accomplished by first moving switch 32*a* from the neutral position shown in FIG. 4*a* into the forward position shown in FIG. 14. This will energize motor 30 causing rotation of shaft 72 and drive gear 70. Drive gear 70 will, in turn, drive driven gear 74 and will rotate camming member 40 via drive chain 84 (FIG. 11). However, because biasing springs 36 of the chucking means are acting to hold the chuck segments 34*a*, 34*b*, and 34*c* in the spaced apart configuration shown in FIGS. 8, 9, and 10, rotation will not be imparted to elongated coil spring 22. To impart rotation to coil spring 22, a downward force is exerted on handle portion 56*a* in the direction of the arrow 63 of FIG. 3. As best seen in FIG. 14, this downward force on handle 56*a* will cause the handle assembly to pivot about a shaft 90 so that teeth 57 of the handle assembly will engage teeth 59 of tubular member 44 urging the tubular member from its rearward starting position (FIG. 7) into the forward position shown in FIG. 14. As previously discussed, this movement of tubular member 44 will cause segmented chuck assembly to be cammed between members 40 and 42 in a manner to move the segments of the chuck into gripping engagement with coil spring 22 in the manner indicated in FIG. 16. As camming member 40, along with the segmented chuck 34 rotates as a result of energization of motor 30, coil spring 22 will also rotate and will be urged forwardly into waste line WL due to the action upon the coil spring by the feed means or feed 60.

Figure 5:
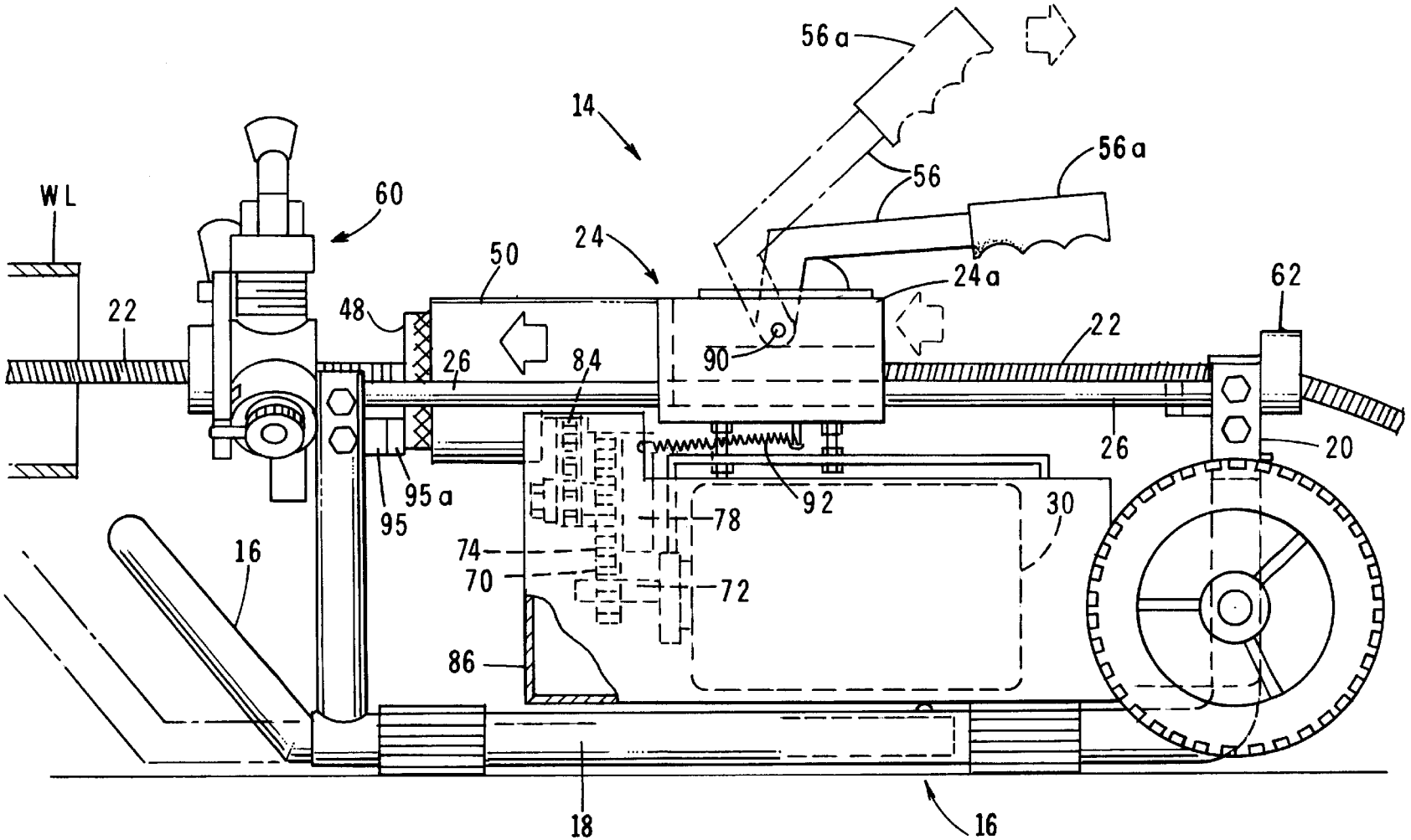
FIG. 5 is a side elevational view similar to FIG. 3, but showing the operating mechanism in a fully advanced position.

As the coiled spring 22 is urged forwardly into the waste line by the feed means, the entire carriage assembly will also be moved forwardly from the position shown in FIG. 3 to the position shown in FIG. 5. When the carriage assemblage reaches its forward most position shown in FIG. 5, a movement of handle 56 from the position shown in the solid lines of FIG. 5 to a position shown by the phantom lines of FIG. 5 will move tubular member 44 to a starting position and will move the chucking means or segmented chuck 34 out of gripping engagement with coil spring 22. In this regard, it is to be noted that a coiled spring 92, which is connected to handle 56 in the manner shown in FIG. 3, resists movement of the handle toward the downward position. Accordingly, when the handle is released, spring 92 will return the handle to its starting position.

It is apparent that during the forward movement of the carriage assembly a predetermined length of coil spring 22 will be inserted into waste line WL by counting the number of times the carriage assembly is moved forwardly due to a downward force being exerted on handle assembly 56. The precise length of cable inserted into waste line WL can be accurately determined. Counting means such as a conventional counter 95 can be mounted on the upper portion 20 of base 16 in the manner shown in FIG. 1. Counter 95 includes a body portion housing the counting mechanism and a plunger portion 95*a* which is impacted by the carriage to trigger the counter each time the carriage is advanced.

Once the carriage assembly is returned to its starting position, by lifting handle 56*a* and, due to the urging of springs, sequential downward forces exerted on handle assembly 56 will cause repetitive reciprocal motion of the carriage assembly along guide members 26 and with each forward movement of the carriage assembly the counter will be triggered and another section of coil spring 22 will be introduced into waste line WL.

Figure 6A:
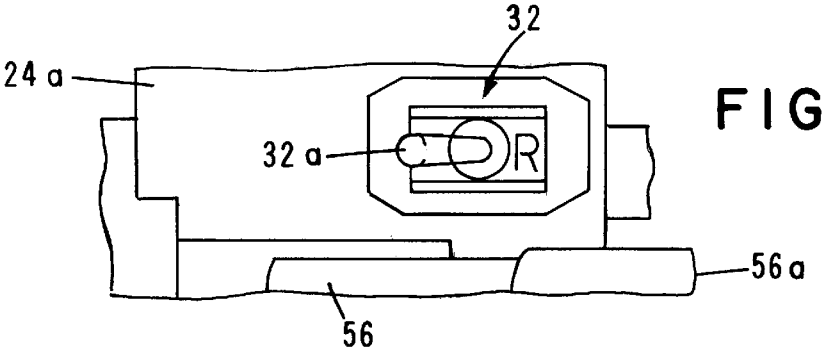
FIG. 6A is an enlarged fragmentary view similar to FIG. 4A but showing the forward and reverse switch in a forward position.
Figures 18, 21:
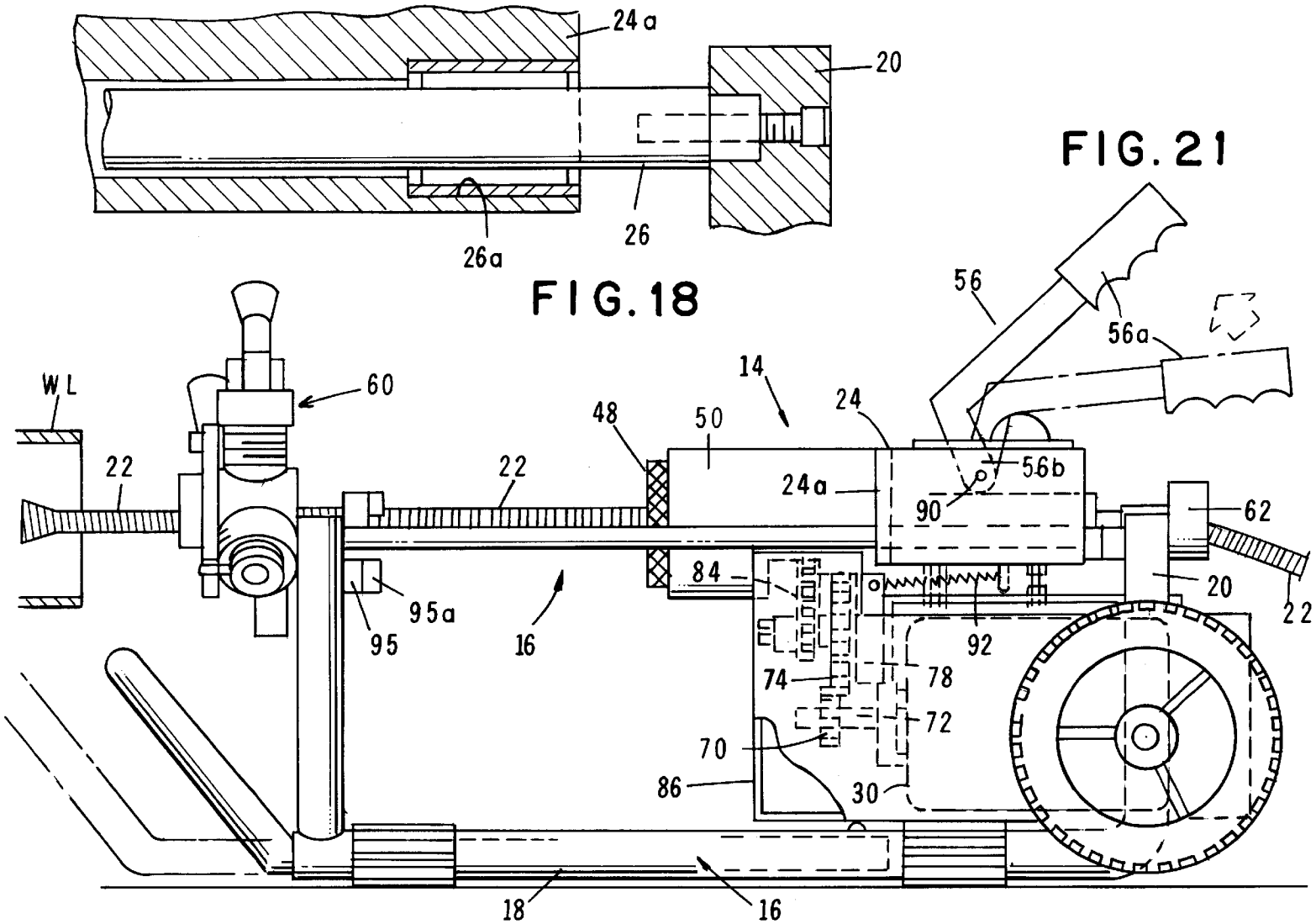
FIG. 18 is a fragmentary, cross-sectional view showing the manner of attachment of the guide rods to the base assembly to permit sliding movement there along of the carriage.
FIG. 21 is a side elevational view similar to FIG. 20 showing the carriage in a fully rearward position.
Figures 19, 20:
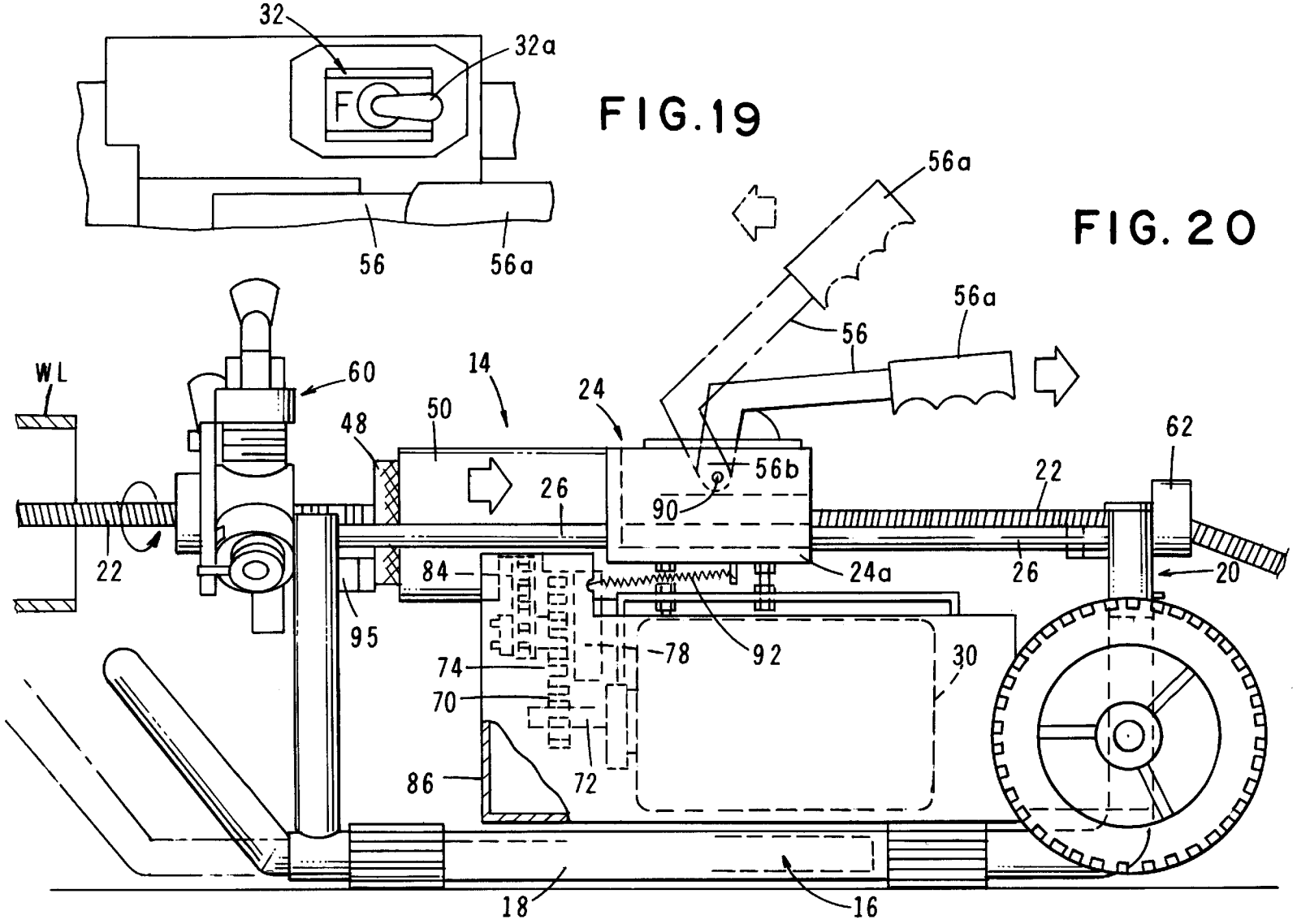
FIG. 19 is a fragmentary view similar to FIG. 6A, but showing the operating switch in a reverse position.
FIG. 20 is a side elevational view similar to FIG. 3 but showing the device in a coil spring retracting mode with the carriage starting to move rearwardly of the base.

When the blockage within the waste line WL is reached and broken up, removal of coil spring 22 from the waste line WL is accomplished by moving switch 32*a* from the position shown in FIG. 6A to the reverse position shown in FIG. 19. This reversal of switch 32 will cause reverse rotation of coil spring 22 from the clockwise rotation illustrated in FIG. 6 to a counter clockwise rotation illustrated in FIG. 20. When the coil spring 22 is rotating in a counter clockwise rotation a downward force exerted on handle assembly 56 from the position shown in the phantom lines in FIG. 20 to the position shown in the solid lines of FIG. 20, will cause the segmented chuck to move into gripping engagement with coil spring 22 so that the coil spring can be retracted from waist line WL by feed means 60. During the snake withdrawal operation, coil spring 22, along with the carriage assembly 24, will move from the forward most position to the rearward most position shown in FIG. 21. With the carriage assembly in this rearward position, an upward movement of handle assembly 56 from the position shown in the phantom lines shown in FIG. 21 to the position shown in the solid lines in FIG. 21, will once again release the segmented chuck from the coil spring 22 so that the carriage assembly can manually urged forwardly into its forward most position. Once in this forward most position, a downward force exerted on handle assembly 56 against the urging of spring 92 will, once again, cause the segmented chuck to grip the coil spring 22, causing a length thereof to be retracted from the waste line and causing the carriage assembly to once again move rearwardly from the position shown in FIG. 20 to the position shown in FIG. 21. Continued reciprocal movement of the carriage assembly in the manner thus described will result in the complete retraction of coil spring 22 from the waste line WL. When the coil spring is fully retrieved from the waste line WL, switch 32*a* can once again be moved into the neutral position de-energizing electric motor 30.

Figure 22:
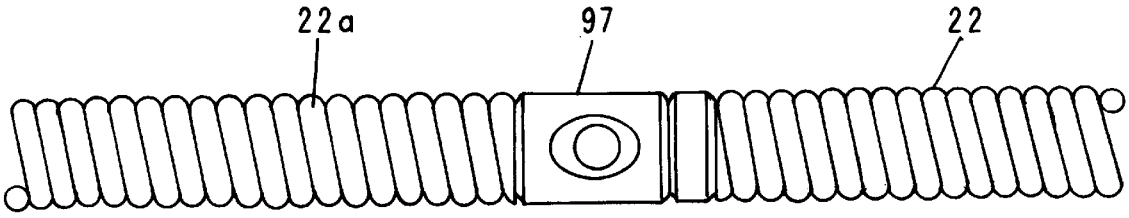
FIG. 22 is a top plan view of a portion of the coiled spring of the clean out device showing the type of connector used to connect together lengths of coiled spring.

If during the waste line clean out operation an additional length of coil spring 22 is required a further length of coil spring designated as 22*a* in FIG. 22 can be added to coil spring 22 by means of a novel connector assembly 97, of the character illustrated in FIG. 22. The construction and operation of connector assembly 97 is fully described in U.S. Letters Patent Ser. No. 4,508,468, which patent is incorporated by referenced as though fully set forth herein.

Figure 23:
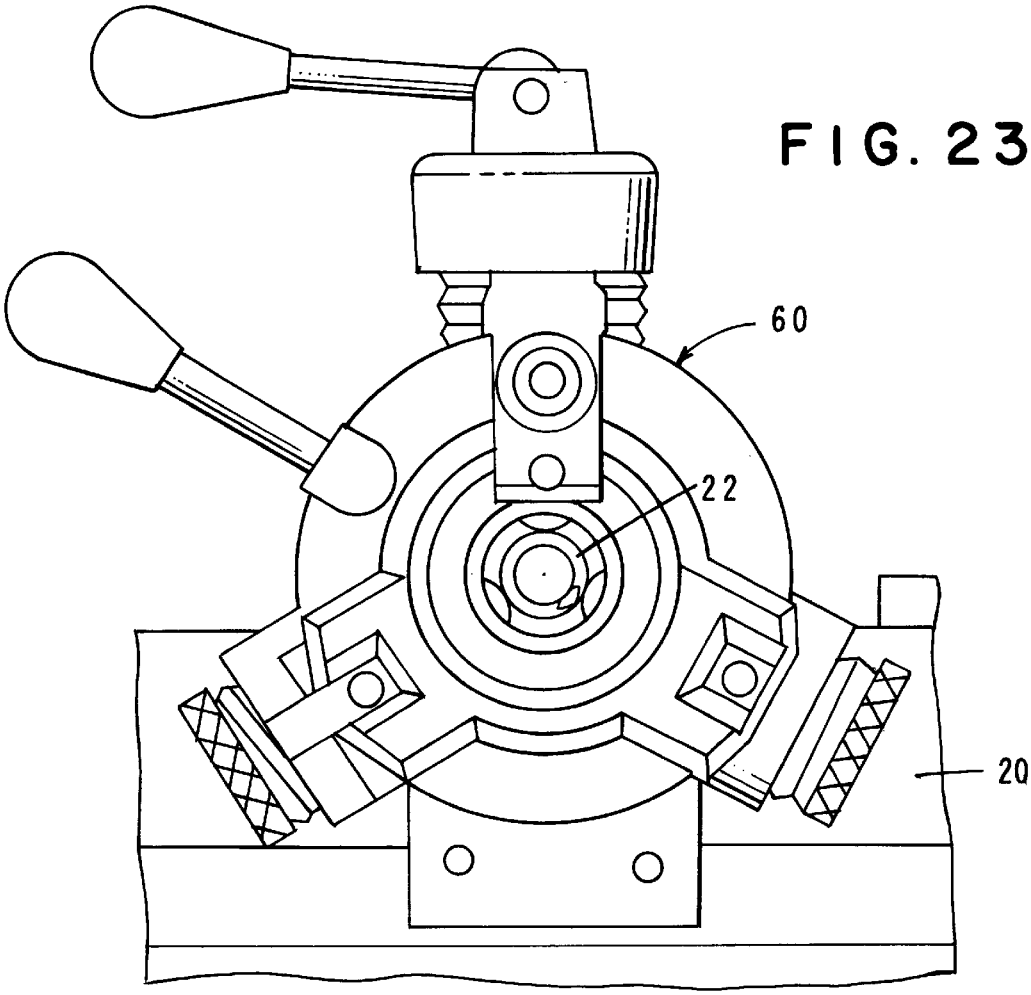
FIG. 23 is an enlarged front view for the feed means of the device for feeding the coiled spring.

As previously mentioned, the novel feed means of the invention illustrated in FIG. 23 is constructed and operated in the manner fully discussed in U.S. Letters Patent Ser. No. 4,580,308, which patent is also incorporated by reference as though fully set forth herein.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

We claim:

1. A waste line clean out tool comprising:

(a) a base;

(b) an elongated coiled spring extending longitudinally of said base;

(c) operating means carried by said base for imparting rotation to said coiled spring, said operating means comprising:

(i) a carriage assembly carried by said base for movement between a first and second position;

(ii) chucking means carried by said carriage assembly for movement between first and second positions for gripping said coiled spring when said chucking means is moved toward said second position; and (iii) drive means for rotating a portion of said chucking means to impart rotation to said coiled spring when said chucking means is in said second position; and (d) feed means mounted on said base for feeding said coiled spring into the waste line upon said coiled spring being rotated by said chucking means.

2. The tool as defined in claim 1 in which said chucking means comprises a coiled spring engaging chuck and in which said tool further involves actuating means carried by said carriage assembly for engagement with said chucking means to cause said chuck to move into gripping engagement with said coiled spring.

3. The tool as defined in claim 2 in which said actuating means comprises a lever pivotally connected to said carriage assembly, said lever having a first handle end and a second end in engagement with said chucking means.

4. The tool as defined in claim 2 in which said base includes guide means for guiding said carriage assembly and in which said carriage assembly of said operating means includes a carriage slidable along said guide means between first and second positions.

5. The tool as defined in claim 4 in which said coiled spring engaging chuck comprises a plurality of chuck segments movable from a first position wherein said segments are spaced apart from said coiled spring to a second position wherein said segments are in gripping engagement with said coiled spring.

6. The tool as defined in claim 5 in which each of said chuck segments includes first and second tapered end portions.

7. The tool as defined in claim 6 in which said chucking means further includes:

(a) a tubular member slidably movable within said carriage assembly;

(b) a first camming member rotatably carried by said tubular member, said first camming member having a tapered surface;

(c) a generally cylindrically shaped housing connected to said carriage assembly; and (d) a second camming member rotatably carried by said housing, said second camming member having a tapered surface, said segmented chuck being disposed between said first and second camming members.

8. The tool as defined in claim 7 in which said drive means comprises a reversible electric motor having a drive shaft.

9. The tool as defined in claim 8 in which said drive means further comprises:

(a) a drive gear connected to said drive shaft;

(b) a driven gear rotatably connected to said base for engagement with said drive gear;

(c) a first sprocket connected to said driven gear;

(d) a second sprocket connected to said chucking means; and (e) a drive chain interconnecting said first and second sprockets.

10. A waste line clean out tool comprising:

(a) a base;

(b) an elongated coiled spring extending longitudinally of said base;

(c) operating means carried by said base for imparting rotation to said coiled spring, said operating means comprising:

(i) a carriage assembly, including a carriage carried by said base for movement between first and second positions;

(ii) chucking means carried by said carriage assembly for movement between first and second positions, said chucking means comprising a coiled spring engaging chuck having a plurality of interconnected segments circumscribing said coiled spring;

(iii) drive means for rotating a portion of said chucking means to impart rotation to said coiled spring when said chucking means is in said second position;

(d) feed means mounted on said base for feeding said coiled spring into the waste line upon said coiled spring being rotated by said chucking means; and (e) actuating means carried by said carriage assembly for engagement with said chucking means to cause said segments of said chuck to move into gripping engagement with said coiled spring.

11. The tool as defined in claim 10 in which said actuating means comprises a lever pivotally connected to said carriage assembly, said lever having a first handle end and a second end operably coupled with said chucking means.

12. The tool as defined in claim 10 in which said chucking means further includes:

(a) a tubular member slidably movable within said carriage;

(b) a first camming member rotatably carried by said tubular member, said first camming member having a tapered surface;

(c) a generally cylindrically shaped housing connected to said carriage; and (d) a second camming member rotatably carried by said housing, said second camming member having a tapered surface, said coiled spring engaging chuck being disposed between said first and second camming members.

13. The tool as defined in claim 10 in which said drive means comprises a reversible electric motor having a drive shaft.

14. The tool as defined in claim 13 in which said drive means further comprises:

(a) a drive gear connected to said drive shaft;

(b) a driven gear rotatably connected to said base for engagement with said drive gear;

(c) a first sprocket connected to said driven gear;

(d) a second sprocket connected to said chucking means; and (e) a drive chain interconnecting said first and second sprockets.

15. A waste line clean out tool comprising:

(a) a base;

(b) an elongated coiled spring extending longitudinally of said base;

(c) operating means carried by said base for imparting rotation to said coiled spring, said operating means comprising:

(i) a carriage assembly, including a carriage carried by said base for movement between first and second positions;

(ii) chucking means carried by said carriage assembly for movement between first and second positions, said chucking means comprising:

a. a coiled spring engaging chuck having a plurality of interconnected segments circumscribing said coiled spring;

b. a tubular member slidably movable within said carriage;

c. a first camming member rotatably carried by said tubular member, said first camming member having a tapered surface;

d. a generally cylindrically shaped housing connected to said carriage; and e. a second camming member rotatably carried by said housing, said second camming member having a tapered surface, said coiled spring engaging chuck being disposed between said first and second camming member;

(iii) drive means for rotating a portion of said chucking means to impart rotation to said coiled spring when said chucking means is in said second position;

(d) feed means mounted on said base for feeding said coiled spring into the waste line upon said coiled spring being rotated by said chucking means; and (e) actuating means carried by said carriage assembly for engagement with said chucking means to cause said segments of said chuck to move into gripping engagement with said coiled spring, said actuating means comprising a lever pivotally connected to said carriage assembly, said lever having a first handle end and a second end operably coupled with said chucking means.

16. The tool as defined in claim 15 in which said drive means comprises a reversible electric motor having a drive shaft.

17. The tool as defined in claim 16 in which said drive means further comprises:

(a) a drive gear connected to said drive shaft;

(b) a driven gear rotatably connected to said base for engagement with said drive gear;

(c) a first sprocket connected to said driven gear;

(d) a second sprocket connected to said chucking means; and (e) a drive chain interconnecting said first and second sprockets.

18. The tool as defined in claim 17 in which said drive means further includes switch means for energizing said motor for said drive shaft to rotate in first and second directions.

19. The tool as defined in claim 17 further including biasing means for yieldably resisting movement of said carriage toward said second position.

20. The tool as defined in claim 17 further including counting means mounted on said base for engagement by said carriage for counting the number of movements of said carriage to said second position.

* * * * *